US012241192B2

(12) United States Patent
Haglund et al.

(10) Patent No.: US 12,241,192 B2
(45) Date of Patent: Mar. 4, 2025

(54) SEWING MACHINE ANKLE ASSEMBLIES HAVING A RESILIENT MEMBER FOR ATTACHING A PRESSER FOOT

(71) Applicant: Singer Sourcing Limited LLC, Lavergne, TN (US)

(72) Inventors: Ida Maria Haglund, Habo (SE); Staffan Svensson, Jönköping (SE)

(73) Assignee: Singer Sourcing Limited LLC, Nashville, TN (US)

( * ) Notice: Subject to any disclaimer, the term of this patent is extended or adjusted under 35 U.S.C. 154(b) by 147 days.

(21) Appl. No.: 17/890,718

(22) Filed: Aug. 18, 2022

(65) Prior Publication Data

US 2024/0060223 A1 Feb. 22, 2024

(51) Int. Cl.
*D05B 29/12* (2006.01)

(52) U.S. Cl.
CPC ..... *D05B 29/12* (2013.01)

(58) Field of Classification Search
CPC ..... D05B 29/12; D05B 29/06; D05B 29/08
See application file for complete search history.

(56) References Cited

U.S. PATENT DOCUMENTS 2,985,127 A * 5/1961 Reeber et al. ..... D05B 29/12 112/240
3,145,674 A * 8/1964 Kurihara ..... D05B 29/12 D15/72
3,294,048 A * 12/1966 Micale ..... D05B 29/12 112/240
3,489,114 A 1/1970 Seck
3,800,720 A * 4/1974 Niino ..... D05B 29/12 112/235
4,213,411 A 7/1980 Knowles
4,359,955 A * 11/1982 Hida ..... D05B 29/12 112/150
4,492,173 A 1/1985 Hirose
4,643,116 A 2/1987 Ulmer et al.
5,048,437 A * 9/1991 Jimenez ..... D05B 79/00 112/235
5,054,407 A * 10/1991 Rowley ..... D05B 35/06 112/152
5,676,075 A * 10/1997 Chen ..... D05B 29/12 112/240

FOREIGN PATENT DOCUMENTS

SE 225248 A 4/1968

* cited by examiner

*Primary Examiner* — Nathan E Durham
(74) *Attorney, Agent, or Firm* — Olive Law Group, PLLC

(57) ABSTRACT

Sewing machine ankle assemblies having a resilient member for attaching a presser foot are disclosed. According to an aspect, a sewing machine ankle assembly includes an ankle comprising an upper portion and a lower portion. The lower portion defines at least one structure configured to receive an attachment mechanism of the presser foot. The sewing machine ankle assembly also includes a resilient member comprising an upper end and an opposing lower end. The upper end is attached to the upper portion of the ankle. The lower end is positioned beneath a portion of the attachment mechanism of the presser foot when the attachment mechanism is received by the at least one structure of the ankle such that the lower portion of the resilient member exerts a force on the portion of the attachment mechanism in a direction towards the at least one structure of the ankle.

17 Claims, 11 Drawing Sheets

SEWING MACHINE ANKLE ASSEMBLIES HAVING A RESILIENT MEMBER FOR ATTACHING A PRESSER FOOT

TECHNICAL FIELD

The presently disclosed subject matter relates generally to sewing machines. Particularly, the presently disclosed subject matter relates to sewing machine ankle assemblies having a resilient member for attaching a presser foot.

BACKGROUND

Sewing machines are well-known devices for sewing fabric and other materials together with thread. They include a needle and a presser foot. The presser foot is used to urge material being sewn toward a feed dog, which includes metal teeth for grabbing onto the material. When the needle is withdrawn from material being sewn, the feed dog is pushed up through slots in the machine surface, then dragged horizontally past the needle. The feed dog is serrated to grip the material, and the presser foot keeps the material in contact with the feed dogs. At the end of their horizontal motion, the feed dog is lowered again and returned to its original position while the needle makes its next pass through the material.

The presser foot is attachable to a presser foot attachment arrangement of the sewing machine, which is attached to a presser bar of the sewing machine. A lower portion of the presser foot includes a sole plate that interfaces with the material being sewn. There are different types of presser feet, which are used depending on their application for sewing. Therefore, it is beneficial if a presser foot is easily attachable and removable from the sewing machine ankle. In addition, it is desired for the presser foot to be securely attached to the ankle.

BRIEF DESCRIPTION OF THE DRAWINGS

Figure 1:
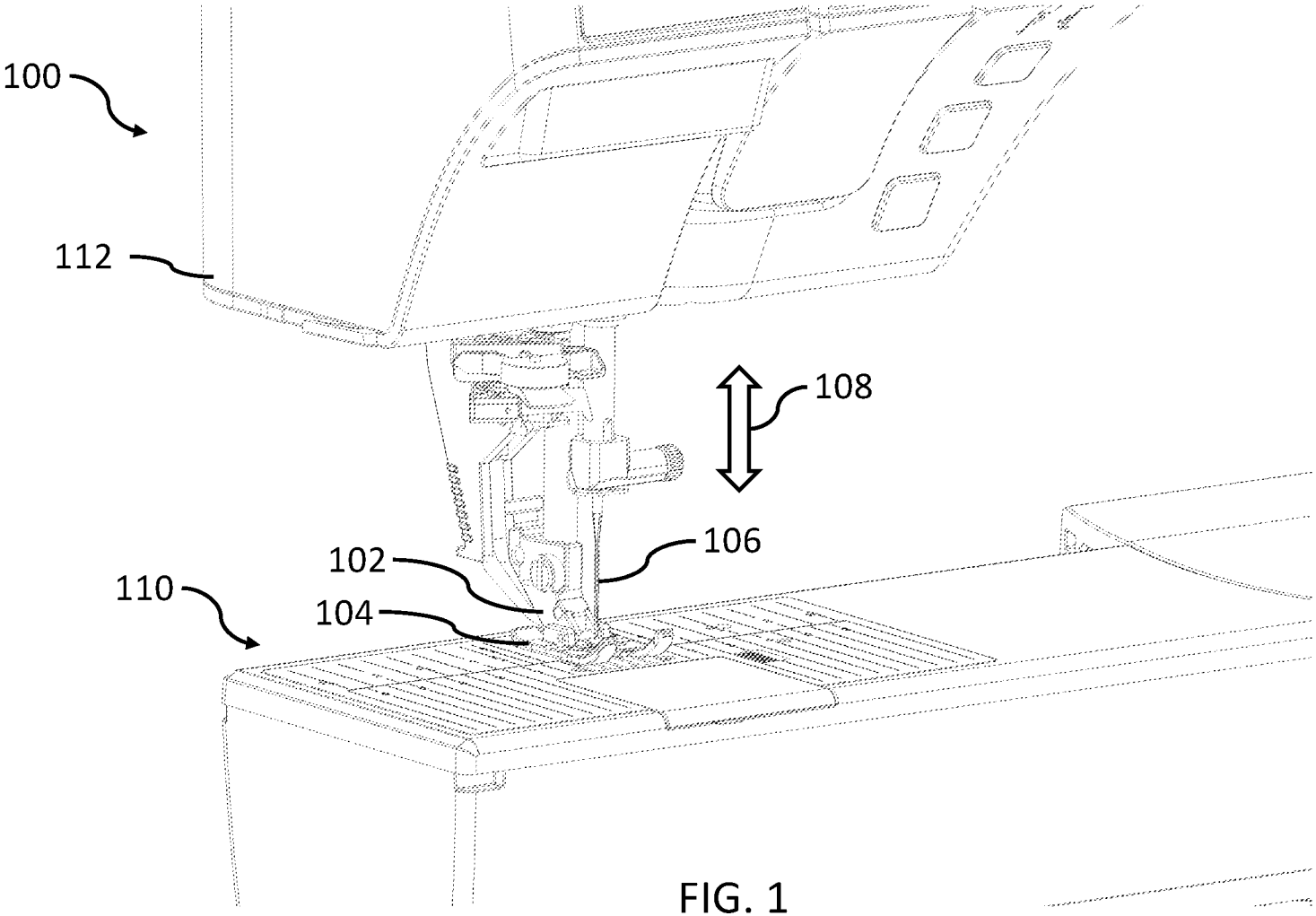
Figure 2:
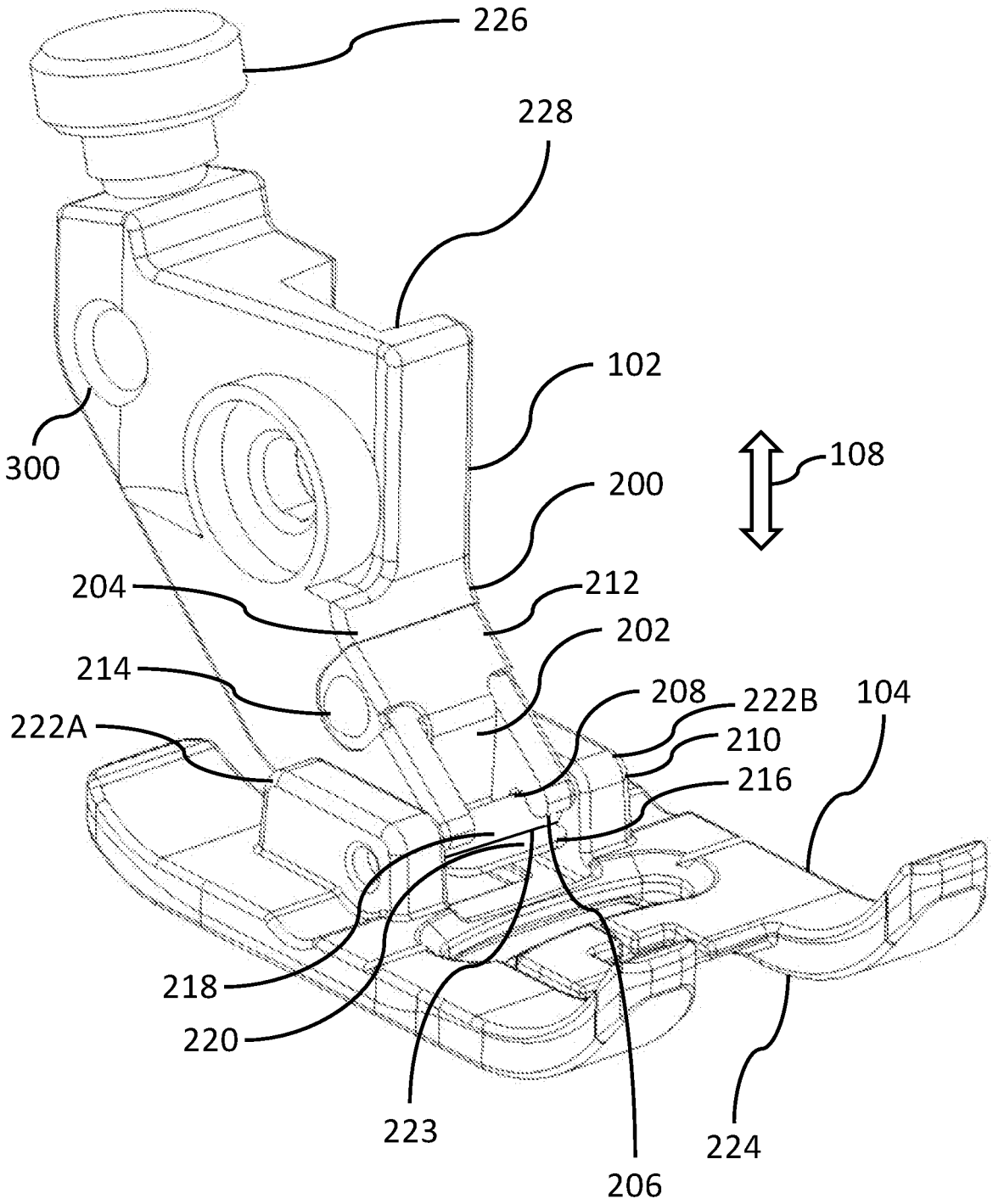
Figure 3:
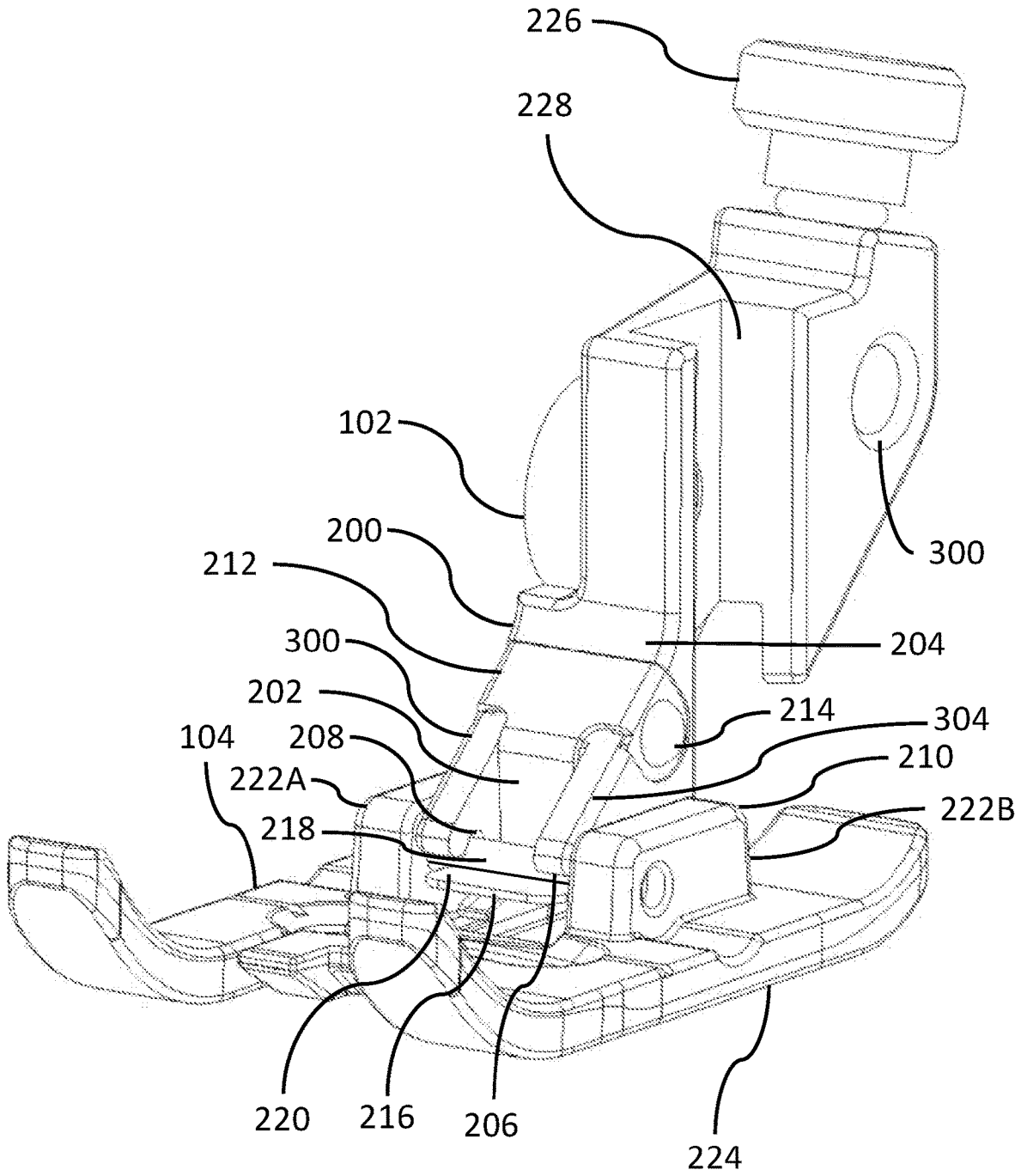
Figure 4:
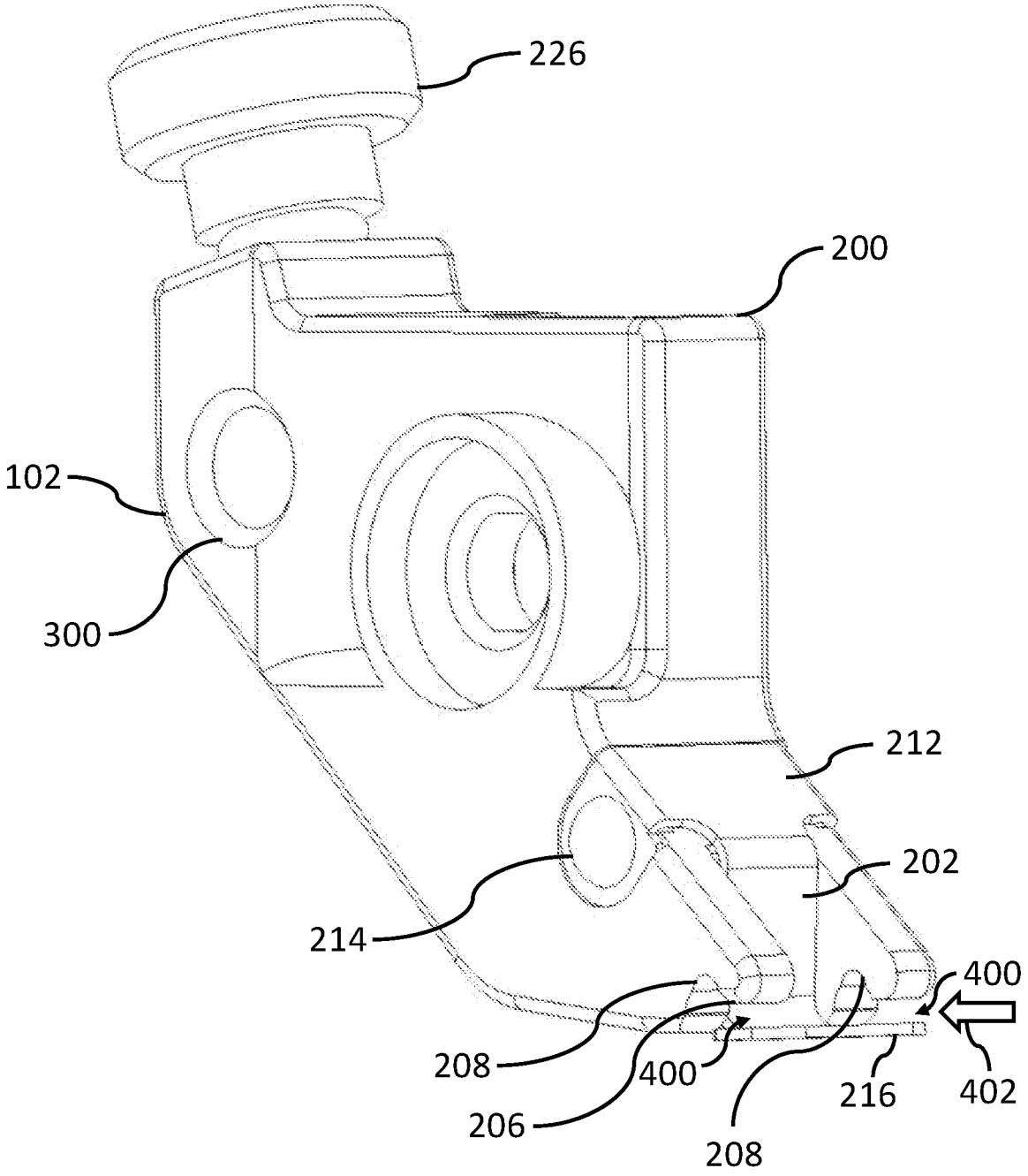
Figure 5:
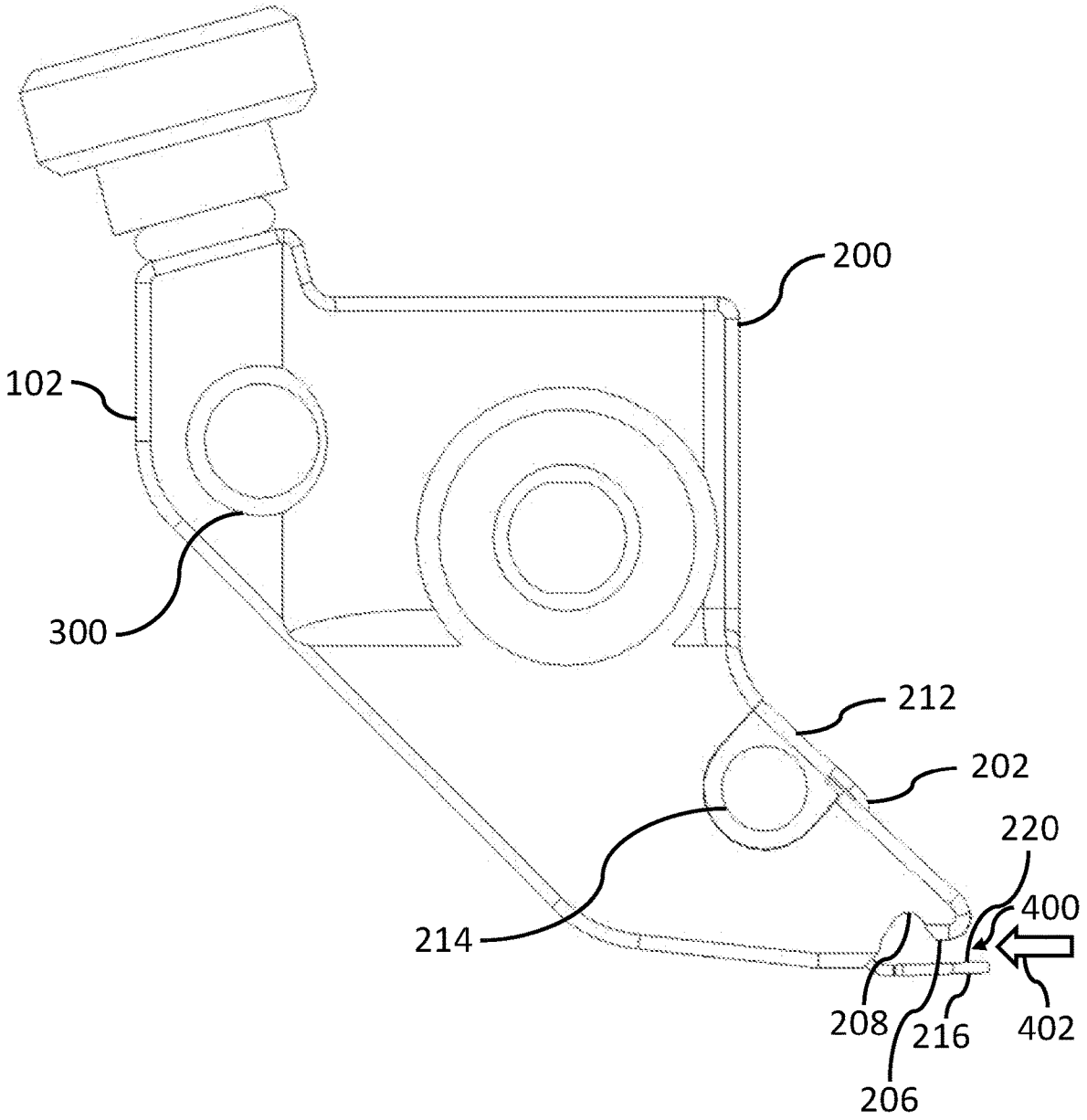
Figure 6:
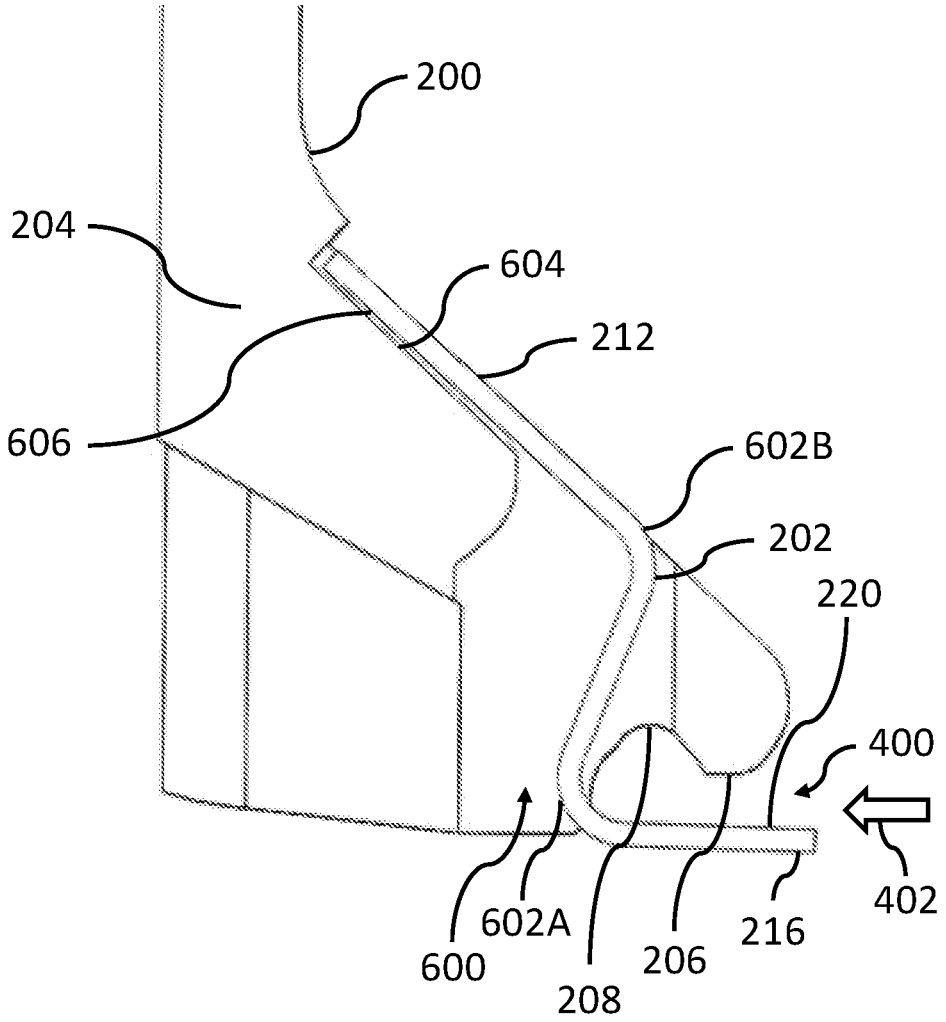
Figure 7:
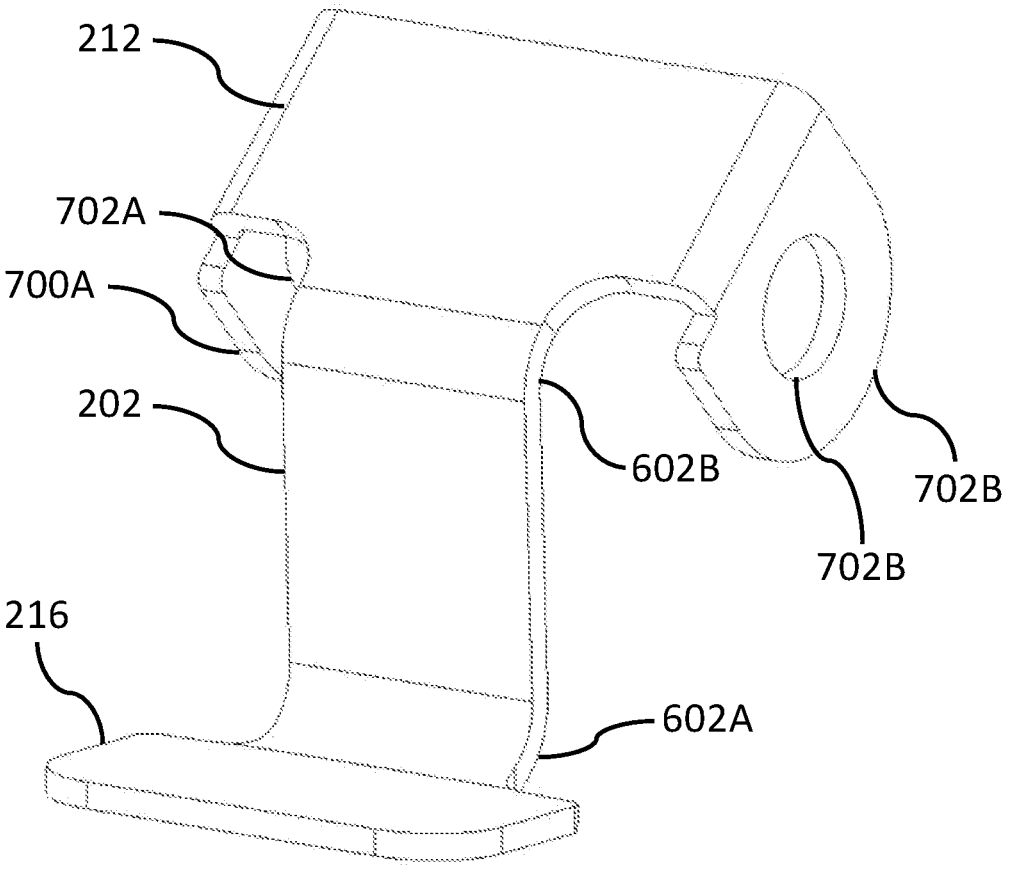
Figure 8:
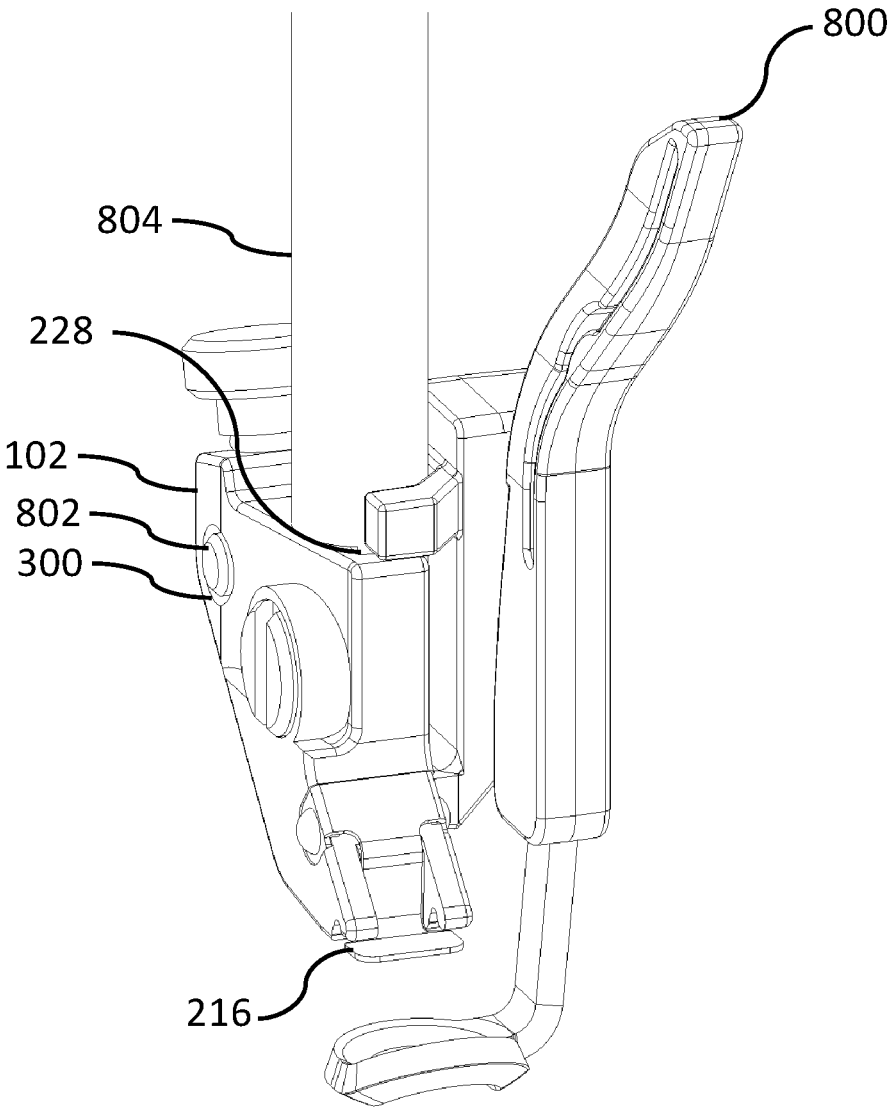
Figure 9:
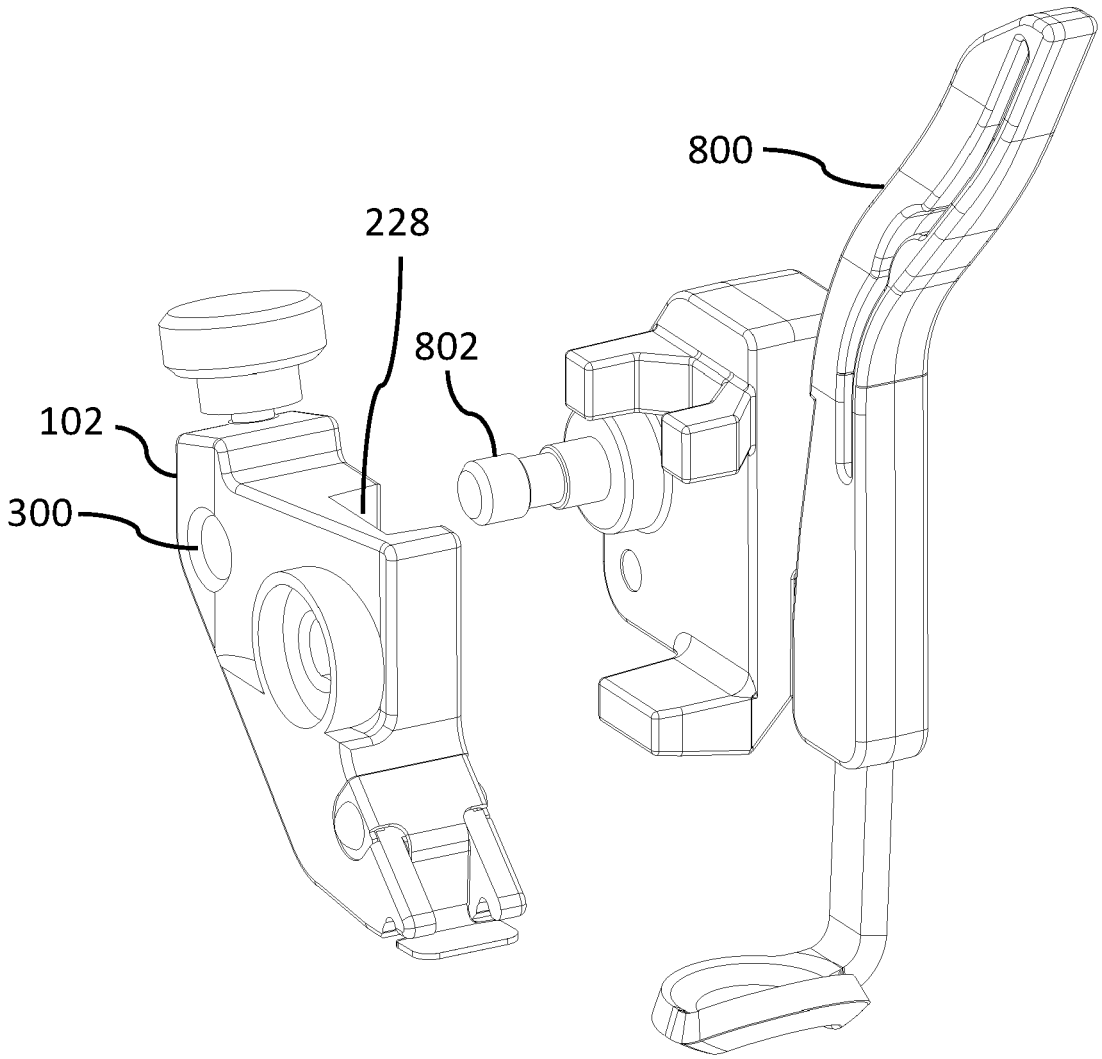
Figure 10:
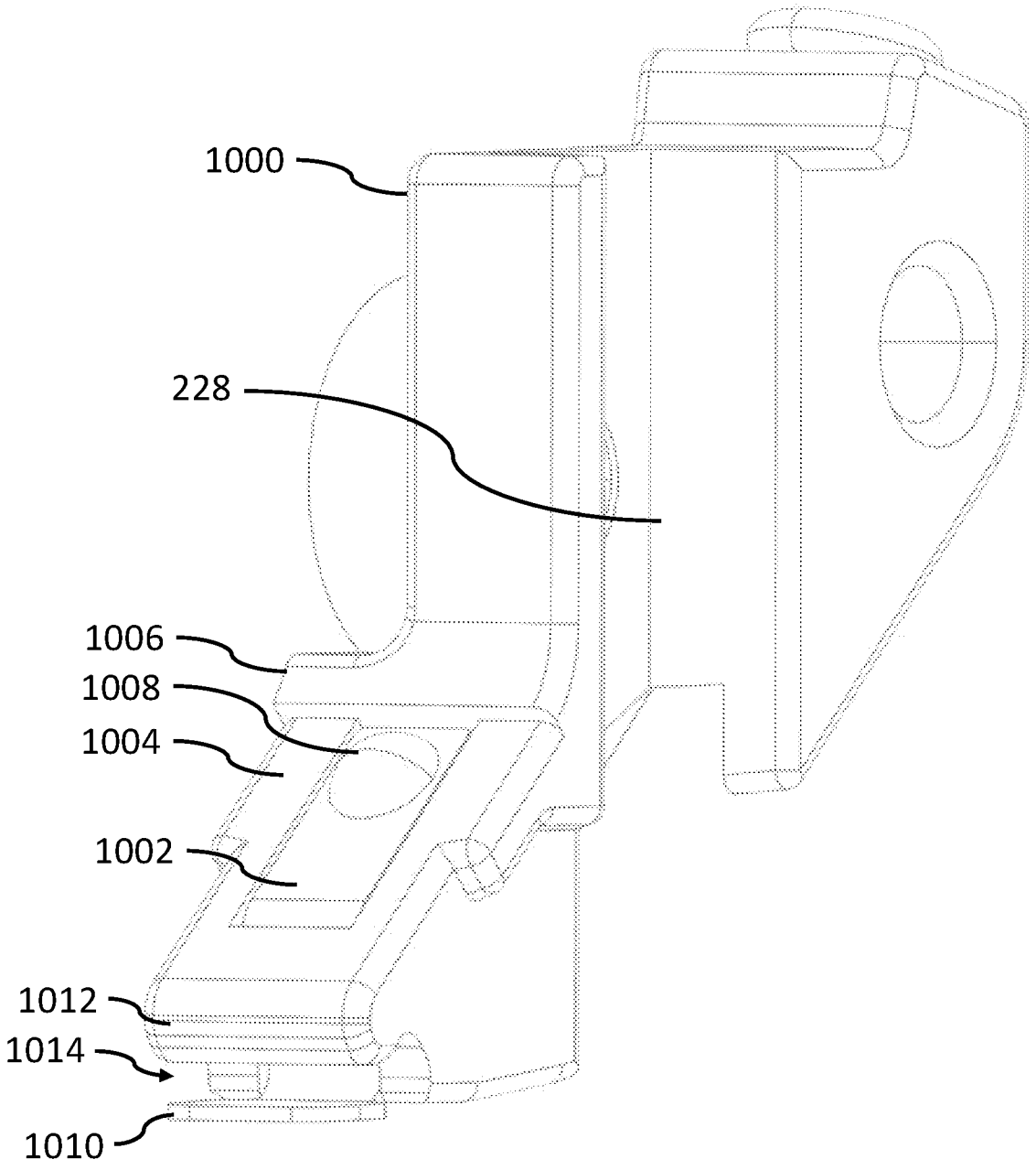
Figure 11:
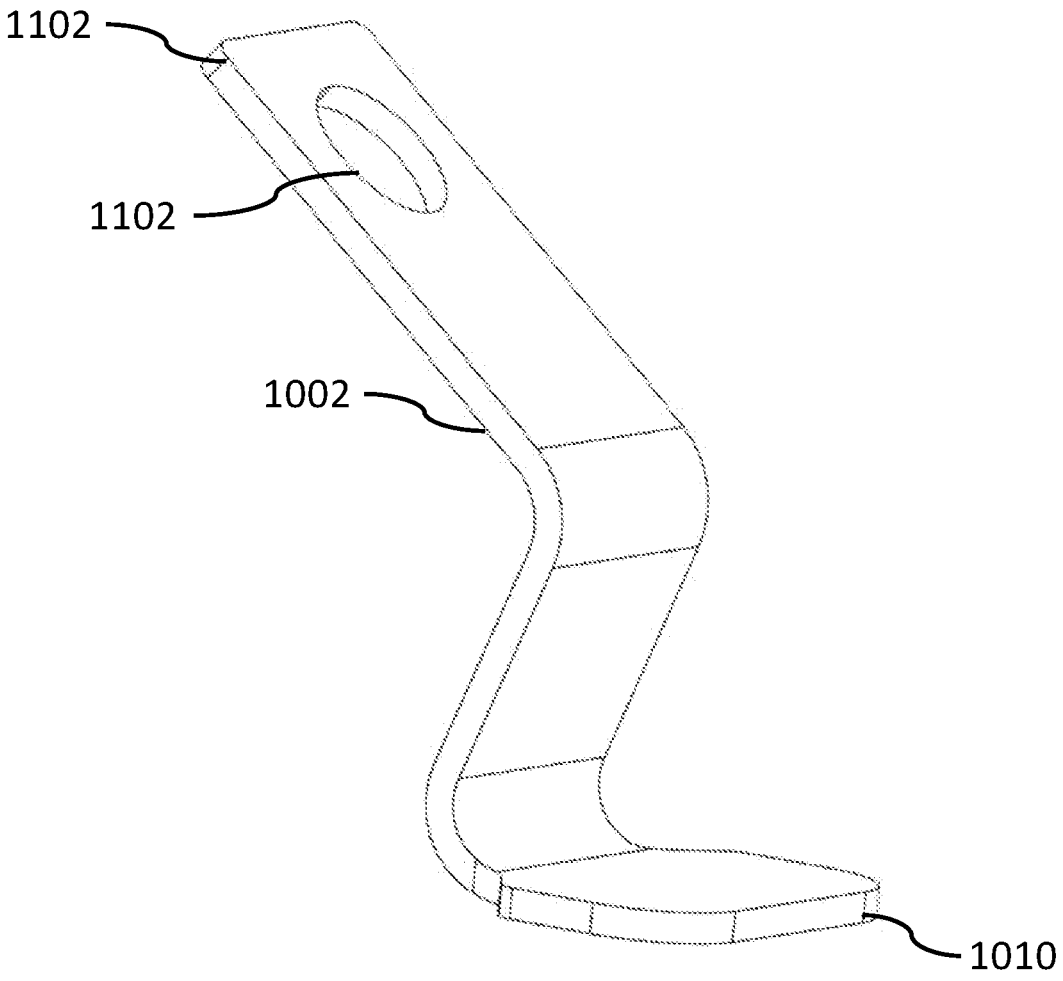

Having thus described the presently disclosed subject matter in general terms, reference will now be made to the accompanying Drawings, which are not necessarily drawn to scale, and wherein:

FIG. 1 is a close, perspective view of a sewing machine including an ankle assembly for attachment to a presser foot in accordance with embodiments of the present disclosure;

FIG. 2 is a perspective view of the presser foot as attached to the ankle assembly for sewing;

FIG. 3 is another perspective view of the presser foot as attached to the ankle assembly;

FIG. 4 is a perspective view of the ankle assembly without a presser foot being attached thereto;

FIG. 5 is a side view of the ankle assembly shown in FIG. 4;

FIG. 6 is a cross-sectional side view of the ankle assembly shown in FIGS. 4 and 5;

FIG. 7 is a perspective view of the resilient member;

FIG. 8 is a perspective view showing an accessory attached to the ankle assembly in accordance with embodiments of the present disclosure;

FIG. 9 is a perspective view showing the accessory and the ankle assembly shown in FIG. 8 with the accessory being separated from the ankle assembly;

FIG. 10 is a perspective view of another ankle assembly in accordance with embodiments of the present disclosure; and FIG. 11 illustrates a perspective view of the resilient member shown in FIG. 12.

SUMMARY

The presently disclosed subject matter relates to a presser foot attachment arrangement of a sewing machine. In the following, the presser foot attachment arrangement is referred to as an ankle assembly having a resilient member for attaching a presser foot. According to an aspect, a sewing machine ankle assembly includes an ankle comprising an upper portion and a lower portion. The lower portion defines at least one structure configured to receive an attachment mechanism of the presser foot. The sewing machine ankle assembly also includes a resilient member comprising an upper end and an opposing lower end. The upper end is attached to the upper portion of the ankle. The lower end is positioned beneath a portion of the attachment mechanism of the presser foot when the attachment mechanism is received by the at least one structure of the ankle such that the lower portion of the resilient member exerts a force on the portion of the attachment mechanism in a direction towards the at least one structure of the ankle for holding the portion of the attachment mechanism together with the at least one structure of the ankle.

According to another aspect, the upper end of the resilient member may be in connection with a surface portion of the ankle, so that when the resilient member is biased, the resilient member is supported at the upper portion of the ankle.

In another aspect, the resilient member may comprise a flat spring.

In another aspect, the flat spring may comprise a first end and a second end. The first end of the flat spring may be attached to the upper portion of the ankle. The second end may be positioned beneath the portion of the attachment mechanism.

In another aspect, the second end of the flat spring may define a surface facing towards the structure, configured to support the attachment mechanism when the attachment mechanism is received by the at least one structure of the ankle.

In another aspect, the resilient member may be arranged to the ankle presenting a substantially symmetrical arrangement as viewed from a front of the sewing machine.

In another aspect, the sewing machine ankle assembly may comprise at least one pin that attaches the upper end of the resilient member to the upper portion of the ankle.

In another aspect, the pin may be arranged at substantially a center of the resilient member.

In another aspect, the resilient member may be attached at two locations arranged on either side of the upper portion of the resilient member.

In another aspect, the at least one structure of the ankle and the lower end of the resilient member may form an opening for receipt and release of the attachment mechanism of the presser foot.

In another aspect, the opening may be substantially forward facing in relation to a front of the sewing machine.

In another aspect, the at least one structure may comprise a plurality of notches that face in a substantially downward direction.

In another aspect, the resilient member may be made of metal. The resilient member may also be of a resilient plastic material.

In another aspect, the upper portion may define an aperture for attachment of an accessory.

In another aspect, the ankle may comprise a connection portion for attachment to a body of a sewing machine.

According to another aspect, a sewing machine ankle assembly may include an ankle comprising an upper portion and a lower portion. The lower portion may define at least one structure configured to receive an attachment mechanism of a presser foot. The sewing machine ankle assembly may include a resilient member comprising an upper end and an opposing lower end. The upper end may be attached to the upper portion of the ankle. The lower end may be positioned beneath a portion of the structure, resiliently movable relative to the structure and configured to exert a force on a portion of the attachment mechanism in a direction towards the at least one structure of the ankle for holding the portion of the attachment mechanism together with the at least one structure of the ankle.

According to another aspect, a force may be transferred via the resilient member and supported by the ankle at the upper portion of the ankle upon biasing of the resilient member at its lower portion.

According to another aspect, a sewing machine ankle and presser foot system may include an ankle comprising an upper portion and a lower portion. The system may also include a resilient member comprising an upper end and an opposing lower end. Further, the system includes a presser foot arranged to be engaged with the ankle. The lower portion of the ankle may define at least one structure configured to receive an attachment mechanism of the presser foot. The upper end of the resilient member may be attached to the upper portion of the ankle. The lower end may be positioned beneath a portion of the attachment mechanism of the presser foot when the attachment mechanism is received by the at least one structure of the ankle such that the lower portion of the resilient member exerts a force in a direction towards the at least one structure of the ankle for holding the portion of the attachment mechanism together with the at least one structure of the ankle.

According to another aspect, the attachment mechanism may comprise a substantially flat bottom surface that sits on top surface of the flat spring.

According to another aspect, the attachment mechanism of the presser foot may comprise a crossbar and a first support and a second support. The crossbar may be attached between the first support and the second support. The crossbar may be received by the at least one structure of the ankle such that the first and second supports are located on each side of the structure.

According to another aspect, the lower portion of the resilient member may exert the force on the crossbar.

According to another aspect, the at least one structure may comprise a plurality of notches that face in a substantially downward direction. The notches each have a concave shape configured to receive the attachment mechanism of the presser foot. The concave shape may correspond to the shape of the crossbar of the presser foot.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

The described features, structures, or characteristics may be combined in any suitable manner in one or more embodiments. In the following description, numerous specific details are provided, to provide a thorough understanding of embodiments of the disclosed subject matter. One skilled in the relevant art will recognize, however, that the disclosed subject matter can be practiced without one or more of the specific details, or with other methods, components, materials, etc. In other instances, well-known structures, materials, or operations are not shown or described in detail to avoid obscuring aspects of the disclosed subject matter.

FIG. 1 illustrates a close, perspective view of a sewing machine 100 including an ankle assembly 102 for attachment to a presser foot 104 in accordance with embodiments of the present disclosure. Referring to FIG. 1, the sewing machine 100 also includes a vertically-mounted needle 106. The presser foot 104 holds cloth or other material in place beneath it while the needle 106 moves upward and downward along a vertical direction (indicated by double arrow 108) for sewing together material as will be understood by those of skill in the art. The sewing machine 100 further includes a work area, generally designated 110, that is positioned beneath an upper portion or head 112 of the sewing machine.

FIG. 2 illustrates a perspective view of the presser foot 104 as attached to the ankle assembly 102 for sewing. Referring to FIG. 2, the ankle assembly 102 includes an ankle 200 and a resilient member 202. The ankle 200 has an upper portion 204 and a lower portion 206. The upper portion 204 is generally positioned above the lower portion 206 along the vertical direction 108. The lower portion 206 defines structures (only one of which is shown in FIG. 2 and designated by reference 208; the other 208 is shown in FIG. 3) configures to receive an attachment mechanism 210 of the presser foot 104.

The resilient member 202 operates with the structures 208 of the ankle 200 to hold the attachment mechanism in place. Particularly, in this example, the resilient member 202 is a flat spring having an end 212 attached to the ankle 200 at its upper portion 204. The end 212 defines a surface 606 (not shown in FIG. 2 but viewable in FIG. 6) that faces toward the upper portion 204 of the ankle 200. The resilient member 202 is attached to the upper portion 204 by pins 214 (only one of which is shown in FIG. 2). The flat spring also has an end 216 that opposes the end 212. As shown in FIG. 2, the end 212 is an upper end, and the end 216 is a lower end. The resilient member 202 may be an alternative suitable type of spring and be made of any suitable, flexible material such as, but not limited to, metal and/or plastic. The resilient member 202 is arranged to the ankle 200 such that it presents a substantially symmetrical arrangement as viewed from a front of the sewing machine.

The lower end 216 is positioned beneath a portion 218 of the attachment mechanism 210 of the presser foot 104. The lower end 216 defines a top surface 220 upon which the portion 218 of the attachment mechanism 210 sits when the attachment mechanism 210 is in this received position. In this position, the end 216 of the resilient member 202 exerts an upward force on the portion 218 of the attachment mechanism 210 in a direction towards the structures 208 of the ankle 200 for holding the portion 218 of the attachment mechanism 210 together with the structures 208 of the ankle 200. Due to the end 212 being attached an opposing side of the ankle 200, it more strongly opposes the forces on the end 216 in the downward direction than if attached at another point of attachment. It is noted that upon biasing of the resilient member 202 at its lower portion 216, a force is transferred via the resilient member 202 and supported by the ankle 200 at the upper portion 204 of the ankle 200.

With continuing reference to FIG. 2, the attachment mechanism 210 includes the portion 218 is a crossbar in this example. The crossbar 218 is carried on its ends by supports 222A and 222B. The supports 222A and 222B are attached at their respective bottoms to a sole plate 224 that keeps material to be sewn in contact with feed dogs (not shown) of the sewing machine. The crossbar 218 can have any suitable shape or size. In an example, the crossbar 218 has a substantially flat surface 223 defined on its underside. In another example, the crossbar 218 may be substantially round or cylindrical in its cross-section. The lower portion 216 of the resilient member 202 can exert an upward force on the crossbar 218 (e.g., on the flat surface 223 of the crossbar 218) keep the cross bar from being disengaged from the lower portion.

The ankle assembly 102 also includes a screw 226 at its upper portion 204 for attachment of an accessory (e.g., accessory 800 shown in FIG. 8). For example, the screw 226 can be turned to thereby tighten the accessory 800 to the ankle 200. The ankle 200 is attached to the presser bar (e.g., the presser bar 804 shown in FIG. 8) via a vertical recess 228. This recess ensures that the ankle assembly 102 is aligned in its correct position.

FIG. 3 illustrates another perspective view of the presser foot 104 as attached to the ankle assembly 102. Referring to FIG. 3, in this view the other pin 214 that attaches the resilient member 202 to the upper portion 204 is shown. In some embodiments, the pins 214 can be a single pin extending through the upper portion 204 between a first peripheral wall 302 to a second peripheral wall 304 of the ankle 200. As can be seen in FIGS. 2 and 3, structures 208 are notches that face in a substantially downward direction. These notches are shaped and sized for fitting to the crossbar 218 near its ends. The notches can each have a concave shape or other suitable shape for receiving the attachment mechanism. The notches may also be represented by a single structure or more than one structure.

The upper portion 204 comprises an aperture 300 that extends horizontally through the upper portion 204. The ends of the aperture 300 can be seen in FIGS. 2 and 3. As will be described in further detailed, the aperture 300 can be used for attachment of an accessory.

FIG. 4 illustrates a perspective view of the ankle assembly 102 without a presser foot being attached thereto. Referring to FIG. 4, it is shown that the lower end 216 of the resilient member 202 and the lower portion 206 of the ankle 200 form openings for receipt and release of an attachment mechanism (e.g., attachment mechanism 210 of the presser foot 104 shown in FIGS. 2 and 3) of a presser foot. In this example, two openings 400 are formed that correspond to the structures 208 (notches in this example), although any suitable number of openings may be similarly defined.

With continuing reference to FIG. 4, the openings 400 are substantially forward facing in relation to a front of the sewing machine. Further, the openings 400 provide passageways for an attachment mechanism of a presser foot to be inserted for fitting to the structures 208. For example, the portion 218 of the attachment mechanism 210 shown in FIGS. 2 and 3 can be inserted by moving it in a direction generally indicated by arrow 400. During insertion, the lower end 216 of the resilient member 202 can deflect while receiving the portion of the attachment mechanism. Further, the resistance of the lower end 216 of the resilient member 202 provides an upward force towards the portion of the attachment mechanism to position the portion against the notches 208 and to hold the portion of the attachment mechanism in place as shown in FIGS. 2 and 3. The attachment mechanism can be released from the position shown in FIGS. 2 and 3 by pulling it in a direction substantially opposite that of direction arrow 402.

FIG. 5 illustrates a side view of the ankle assembly 102 shown in FIG. 4. As shown, the top surface 220 of the lower end 216 of the resilient member 202 faces upward.

FIG. 6 illustrates a cross-sectional side view of the ankle assembly 102 shown in FIGS. 4 and 5. Referring to FIG. 6, the resilient member 202 has a curved shape with two bends 600A and 600B. Also, a portion of the resilient member 202 extends within an interior space 602 defined within the ankle 200. The end 212 of the resilient member 202 is in connection with a surface portion 604 of the ankle 200, so that that when the resilient member 202 is biased, the resilient member 202 is supported at the upper portion 204 of the ankle 200. As a result, support is provided for biasing forces generated by the resilient member 202.

FIG. 7 illustrates a perspective view of an embodiment of the resilient member 202. In this example, the resilient member 202 is a flat spring made of metal. The resilient member 202 has flanges 700A and 700B on each side of its upper end 212. The flanges 700A and 700B define apertures 702A and 702B, respectively, for receipt of pins (e.g., pins 214 shown in FIGS. 2 and 3) for attachment to an ankle.

FIG. 8 illustrates a perspective view showing an accessory 800 attached to the ankle assembly 102 in accordance with embodiments of the present disclosure. In this example, the accessory 800 is an embroidery foot but may alternatively be any other suitable sewing accessory. The accessory 800 can releasably attach to the side of the ankle assembly 102. The accessory 800 includes an attachment member 802 for fitting into the aperture of the ankle assembly 102. The ankle assembly 102 is attached to a presser bar 804. The presser bar 804 can be raised and lowered in order to lift and lower the presser foot towards the fabric or other material being sewn. As shown, the accessory 800 fits to the presser bar 804.

FIG. 9 illustrates a perspective view showing the accessory 800 and the ankle assembly 102 shown in FIG. 8 with the accessory 800 being separated from the ankle assembly 102. The accessory 800 may be an arrangement of an embroidery foot for use in a task of embroidery. With this ankle assembly, operation time can be saved because the operator does not need to remove the ankle before attaching the embroidery foot to the machine, since it arranges directly to the ankle assembly instead. It is noted that the embroidery foot 800 does not press the fabric or other material, because often there is only one ply of textile suspended in an embroidery frame. In operation, the embroidery foot 800 typically hovers over the material to be embroidered and thus the feed dog does not feed the material. More often the embroidery frame is attached to and steered by an embroidery unit as will be understood by those of skill in the sewing arts.

FIG. 10 illustrates a perspective view of another ankle assembly 1000 in accordance with embodiments of the present disclosure. Referring to FIG. 10, in this example the resilient member 1002 is attached to a top portion 1004 of the ankle 1006 by a single pin 1008. The resilient member 1002 extends over the upper portion, and substantially downwards and forwards to a lower end 1010. The lower end is defined by a tongue that reaches forward. When the lower end 1010 is pressed, the spring function of the resilient member allows the resilient member 1002 to form a gap which can slightly increase. Once the pressure is relieved, the resilient member 1002 springs back to its initial position. Similar to the embodiment of FIG. 4, a lower portion 1012 of the ankle 1006 and the lower end 1010 of the resilient member 1002 forms an opening 1014 for receipt of a portion of the presser foot. In this example, the pin 1008 is arranged at substantially a center of the resilient member 1002, although it is noted that the pin 1008 may be arranged at any suitable position for attaching the resilient member 1002.

FIG. 11 illustrates a perspective view of the resilient member 1002 shown in FIG. 12. The resilient member 1002 defines an aperture 1100 at its upper end 1102 for receipt of the pin 1008 shown in FIG. 10. In some embodiments the pin may be incorporated in the ankle. The resilient member may thus be fixated by a nut, solder, or rivet or any other suitable technique for fastening.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A sewing machine ankle assembly comprising:

an ankle comprising an upper portion and a lower portion, wherein the lower portion defines at least one structure configured to receive an attachment mechanism of a presser foot; and a resilient member comprising an upper end and an opposing lower end, wherein the upper end is attached to the ankle, and wherein the lower end is positioned beneath a portion of the attachment mechanism of the presser foot when the attachment mechanism is received by the at least one structure of the ankle such that the lower portion of the resilient member exerts a force in a direction towards the at least one structure of the ankle for holding the portion of the attachment mechanism together with the at least one structure of the ankle; and at least one pin that attaches the upper end of the resilient member to the upper portion of the ankle, wherein the at least one structure of the ankle and the lower end of the resilient member form an opening that faces a substantially horizontal direction for receipt and release of the attachment mechanism of the presser foot along the substantially horizontal direction.

2. The sewing machine ankle assembly of claim 1, wherein the upper end of the resilient member is in connection with a surface portion of the ankle, so that that when the resilient member is biased, the resilient member is supported at the upper portion of the ankle.

3. The sewing machine ankle assembly of claim 2, wherein the resilient member comprises a flat spring.

4. The sewing machine ankle assembly of claim 3, wherein the flat spring comprises a first end and a second end, wherein the first end of the flat spring is attached to the upper portion of the ankle, and wherein the second end is positioned beneath the portion of the attachment mechanism.

5. The sewing machine ankle assembly of claim 4, wherein the second end of the flat spring defines a surface facing towards the at least one structure, and is configured to support the attachment mechanism when the attachment mechanism is received by the at least one structure of the ankle.

6. The sewing machine ankle assembly of claim 5, wherein the resilient member is arranged to the ankle presenting a substantially symmetrical arrangement as viewed from a front of the sewing machine.

7. The sewing machine ankle assembly of claim 1, wherein the at least one pin is arranged at substantially a center of the resilient member.

8. The sewing machine ankle assembly of claim 1, wherein the resilient member is attached at two locations arranged on either side of the upper portion of the ankle.

9. The sewing machine ankle assembly of claim 1, wherein the opening is substantially forward facing in relation to a front of the sewing machine.

10. The sewing machine ankle assembly of claim 1, wherein the resilient member is made of metal.

11. The sewing machine ankle assembly of claim 1, wherein the upper portion defines an aperture for attachment of an accessory.

12. The sewing machine ankle assembly of claim 1, wherein the ankle comprises a connection portion for attachment to a body of a sewing machine.

13. A sewing machine ankle assembly comprising:

an ankle comprising an upper portion and a lower portion, wherein the lower portion defines at least one structure configured to receive an attachment mechanism of a presser foot; and a resilient member comprising an upper end and an opposing lower end, wherein the upper end is attached to the ankle, and wherein the lower end is positioned beneath a portion of the attachment mechanism of the presser foot when the attachment mechanism is received by the at least one structure of the ankle such that the lower portion of the resilient member exerts a force in a direction towards the at least one structure of the ankle for holding the portion of the attachment mechanism together with the at least one structure of the ankle, wherein the at least one structure of the ankle and the lower end of the resilient member form an opening that faces a substantially horizontal direction for receipt and release of the attachment mechanism of the presser foot along the substantially horizontal direction, and wherein the at least one structure comprises a plurality of notches that face in a substantially downward direction.

14. A sewing machine ankle and presser foot system comprising an ankle comprising an upper portion and a lower portion;

a resilient member comprising an upper end and an opposing lower end;

a presser foot arranged to be engaged with the ankle, wherein the lower portion of the ankle defines at least one structure configured to receive an attachment mechanism of the presser foot, and wherein the upper end of the resilient member is attached to the ankle, and wherein the lower end is positioned beneath a portion of the attachment mechanism of the presser foot when the attachment mechanism is received by the at least one structure of the ankle such that the lower portion of the resilient member exerts a force on the portion of the attachment mechanism in a direction towards the at least one structure of the ankle for holding the portion of the attachment mechanism together with the at least one structure of the ankle, wherein the at least one structure of the ankle and the lower end of the resilient member form an opening that faces a substantially horizontal direction for receipt and release of the attachment mechanism of the presser foot along the substantially horizontal direction, and wherein the at least one structure comprises a plurality of notches that face in a substantially downward direction, wherein the notches each have a concave shape configured to receive the attachment mechanism of the presser foot, wherein the concave shape corresponds to the shape of a crossbar of the presser foot.

15. The sewing machine ankle and presser foot system of claim 14, wherein the attachment mechanism comprises a substantially flat bottom surface that sits on top surface of the resilient member.

16. The sewing machine ankle and presser foot system of claim 14, wherein the attachment mechanism of the presser foot comprises the crossbar and a first support and a second support, wherein the crossbar is attached between the first support and the second support, and wherein the crossbar is received by the at least one structure of the ankle such that the first and second supports are located on each side of the structure.

17. The sewing machine ankle and presser foot system of claim 16, wherein the lower portion of the resilient member exerts the force on the crossbar.

* * * * *